US011493284B2

(12) United States Patent
He et al.

(10) Patent No.: US 11,493,284 B2
(45) Date of Patent: Nov. 8, 2022

(54) HEAT EXCHANGER AND FIN

(71) Applicant: SANHUA (HANGZHOU) MICRO CHANNEL HEAT EXCHANGER CO., LTD., Zhejiang (CN)

(72) Inventors: Yan He, Zhejiang (CN); Zhiheng Yan, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 235 days.

(21) Appl. No.: 16/650,286

(22) PCT Filed: Sep. 4, 2018

(86) PCT No.: PCT/CN2018/103996
§ 371 (c)(1),
(2) Date: Mar. 24, 2020

(87) PCT Pub. No.: WO2019/062493
PCT Pub. Date: Apr. 4, 2019

(65) Prior Publication Data

US 2020/0232721 A1 Jul. 23, 2020

(30) Foreign Application Priority Data

Sep. 30, 2017 (CN) ..... 201710938228.9
Sep. 30, 2017 (CN) ..... 201721287031.5

(51) Int. Cl.
*F28F 1/12* (2006.01)

(52) U.S. Cl.
CPC ..... *F28F 1/12* (2013.01)

(58) Field of Classification Search
CPC ..... F28F 1/12; F28F 1/30; F28F 1/32; F28F 2255/08; F28F 2275/06; B21D 19/088; B21D 53/022; F28D 1/04
(Continued)

(56) References Cited

U.S. PATENT DOCUMENTS 2,656,808 A * 10/1953 Plumeri ..... B21C 37/24 29/523
3,068,905 A * 12/1962 Millington ..... F28F 1/28 138/155
(Continued)

FOREIGN PATENT DOCUMENTS

CN 203414006 U 1/2014
CN 105987632 A 10/2016
(Continued)

OTHER PUBLICATIONS

Machine Translation CN 205718622U (Year: 2016).*
(Continued)

*Primary Examiner* — Len Tran
*Assistant Examiner* — Gustavo A Hincapie Serna
(74) *Attorney, Agent, or Firm* — Marshall, Gerstein & Borun LLP

(57) ABSTRACT

A heat exchanger and a fin are provided. The heat exchanger includes: a fin. The fin includes a fin body and a flange, the fin body being provided with a heat exchange tube hole, the flange being provided on the fin body and surrounding the heat exchange tube hole; and a heat exchange tube passing through the heat exchange tube hole and connected to the flange. The flange includes a first sub-flange and a plurality of second sub-flanges, the first sub-flange is connected to the fin body, the plurality of second sub-flanges are connected to the first sub-flange and spaced apart from one another, and a height of the first sub-flange is less than a height of the second sub-flange.

19 Claims, 4 Drawing Sheets

(58) Field of Classification Search
USPC ..... 165/181
See application file for complete search history.

(56) References Cited

U.S. PATENT DOCUMENTS

| | | | | | |
|---|---|---|---|---|---|
| 3,384,168 | A * | 5/1968 | Richter | F24D 19/04 | 165/182 |
| 5,031,694 | A * | 7/1991 | Lloyd | F28F 1/12 | 165/184 |
| 5,117,905 | A * | 6/1992 | Hesse | F28F 1/24 | 165/182 |
| 5,582,246 | A * | 12/1996 | Dinh | F28F 1/24 | 165/181 |
| 5,706,695 | A * | 1/1998 | Helms | F28F 1/32 | 29/890.047 |
| 6,266,882 | B1 * | 7/2001 | Ali | F28F 1/24 | 29/890.046 |
| 6,318,145 | B1 * | 11/2001 | Baba | B21D 39/20 | 72/466 |
| 2005/0155750 | A1 * | 7/2005 | Mitchell | F28F 1/32 | 165/182 |
| 2010/0018691 | A1 * | 1/2010 | Ohgami | F28F 1/325 | 165/185 |
| 2010/0089557 | A1 * | 4/2010 | Kim | F28F 17/005 | 165/182 |
| 2011/0067849 | A1 * | 3/2011 | Fujino | F28F 1/325 | 165/182 |
| 2013/0340986 | A1 * | 12/2013 | Lee | F28F 1/12 | 165/181 |
| 2015/0122471 | A1 * | 5/2015 | Lee | F28F 1/32 | 165/181 |
| 2016/0123681 | A1 | 5/2016 | Honma et al. | | |
| 2016/0273850 | A1 | 9/2016 | Okamoto et al. | | |
| 2017/0248370 | A1 * | 8/2017 | Nakamura | F28D 1/053 | |
| 2018/0306529 | A1 * | 10/2018 | Kasamatsu | B23K 1/0012 | |
| 2019/0086153 | A1 * | 3/2019 | Yoshimura | F28F 1/28 | |

FOREIGN PATENT DOCUMENTS

| | | | | |
|---|---|---|---|---|
| CN | 205718622 | U * | 11/2016 | |
| CN | 206593522 | U | 10/2017 | |
| CN | 207300027 | U | 5/2018 | |
| EP | 2784427 | A1 * | 10/2014 | F28F 1/32 |
| GB | 2110811 | A * | 6/1983 | F28F 1/30 |
| JP | H0958281 | A | 3/1997 | |
| JP | H11294985 | A | 10/1999 | |
| JP | 2004257641 | A | 9/2004 | |
| JP | 2007518962 | A | 7/2007 | |

OTHER PUBLICATIONS

Office Action, corresponding in Japanese patent application No. 2020-537822, dated Jan. 5, 2021. (English Translation) .

Office Action, corresponding in Japanese patent application No. 2020-537822, dated Jul. 1, 2021. (English Translation).

International Search Report for Application No. PCT/CN2018/103996, dated Oct. 17, 2018.

* cited by examiner

HEAT EXCHANGER AND FIN

CROSS-REFERENCE TO RELATED APPLICATION

This application is based on Chinese Patent Applications Serial No. 201710938228.9 and 201721287031.5, filed on Sep. 30, 2017 and claims priorities to the Chinese Patents, the entire contents of which are incorporated herein by reference.

FIELD

The present disclosure relates to a technical field of heat exchange, and more particularly to a heat exchanger and a fin.

BACKGROUND

Outside air is used for heat exchange with a refrigerant in an air-cooled heat exchanger which includes a heat exchange tube and a fin. The refrigerant medium circulates in the heat exchange tube for heat exchange with a wall of the heat exchange tube. The fin exchanges heat with the air. The heat exchange tube is in contact with and connected to the fin contact. Therefore, the connection mode between the heat exchange tube and the fin directly determines the heat exchange efficiency of the heat exchanger.

As for the heat exchanger in the related art, the heat exchange tube passes through the fin and is connected thereto, and the contacting connection between the heat exchange tube and the fin is achieved by physical expansion of tubes, such that the heat exchange tube is closely attached to the fin. Specifically, a full turn of flange is formed at the heat exchange tube hole of the fin, the heat exchange tube expands after being inserted into the heat exchange tube hole, and the fin and the heat exchange tube are tightened by expansion force.

However, the connection between the heat exchange tube and the fin is high in heat transfer resistance, causing low heat transfer efficiency and then affecting the heat exchange efficiency, and the stress is relatively concentrated, which is not conducive to assembling and assembling quality.

SUMMARY

The present disclosure aims to solve at least one of the technical problems existing in the related art. To this end, the present disclosure proposes a heat exchanger having the advantages of high heat exchange efficiency, easy assembling and the like.

The present disclosure also provides a fin.

A heat exchanger is provided according to embodiments of a first aspect of the present disclosure. The heat exchanger includes a fin which includes a fin body and a flange, the fin body being provided with a heat exchange tube hole, and the flange being arranged on the fin body and surrounding the heat exchange tube hole; and a heat exchange tube passing through the heat exchange tube hole and connected to the flange. The flange includes a first sub-flange and a plurality of second sub-flanges, the first sub-flange is connected to the fin body and extends to form a structure in a shape of a closed loop along a circumferential direction of the heat exchange tube hole, the plurality of the second sub-flanges are connected to the first sub-flange and spaced apart from one another along a circumferential direction of the first sub-flange, and a height of the first sub-flange is less than a height of the second sub-flange.

The heat exchanger according to embodiments of the present disclosure has the advantages of high heat exchange efficiency, easy assembling and ensured assembling quality.

According to some specific embodiments of the present disclosure, a plurality of fins are provided, fin bodies of adjacent fins are arranged along a thickness direction of the fin bodies, and a height h of the first sub-flange is greater than a thickness t of the fin body and less than a spacing H between the adjacent fin bodies.

According to some specific embodiments of the present disclosure, a height h of the first sub-flange is greater than or equal to twice a thickness t of the fin body or less than or equal to twenty times the thickness of the fin body.

Furthermore, a height h of the first sub-flange is greater than or equal to four times a thickness t of the fin body or less than or equal to ten times the thickness of the fin body.

According to some specific embodiments of the present disclosure, a plurality of fins are provided, fin bodies of adjacent fins are arranged along a thickness direction of the fin bodies, a minimum inner circumference of the first sub-flange is represented by C, and an unfolded area of the flange 120 is represented by S, and an unfolded height of the flange is represented by H1, $0.1 \leq S/(CH1) \leq 0.9$.

According to some specific embodiments of the present disclosure, a ratio of a sum of widths the plurality of second sub-flanges at a middle positions of in a height direction to a minimum inner circumference of the first sub-flange is represented by β, $0.08 \leq \beta < 1$.

Furthermore, the ratio β of the sum of widths of the plurality of second sub-flanges at the middle position in the height direction to the minimum inner circumference of the first sub-flange further meets a requirement: $0.25 \leq \beta < 0.5$.

Furthermore, the heat exchange tube is configured as a flat tube, a shape of the heat exchange tube hole and a shape of the flange match a shape of the heat exchange tube, and the ratio β of the sum of widths of the plurality of second sub-flanges at the middle position in the height direction to the minimum inner circumference of the first sub-flange further meets a requirement: $0.85 \leq \beta < 1$.

According to some specific embodiments of the present disclosure, a width of the second sub-flange is gradually reduced in a direction away from the first sub-flange.

According to some specific embodiments of the present disclosure, the second sub-flange is bent outwards into an arc structure or a polyline structure along a radial direction of the flange.

According to some specific embodiments of the present disclosure, the heat exchange tube is welded to the flange.

A fin is provided according to embodiments of a second aspect of the present disclosure, the fin includes a fin body provided with a heat exchange tube hole; a flange provided on the fin body and comprising a first sub-flange and a plurality of second sub-flanges, the first sub-flange being connected to the fin body and extending to form a structure in a shape of a closed loop along a circumferential direction of the heat exchange tube hole, the plurality of the second sub-flanges being connected to the first sub-flange and spaced apart from one another along a circumferential direction of the first sub-flange, and a height of the first sub-flange being less than a height of the second sub-flange.

According to some specific embodiments of the present disclosure, an end of the first sub-flange adjacent to the second sub-flange is inwardly inclined along a radial direction of the heat exchange tube hole with respect to an end of the first sub-flange adjacent to the fin body.

The fin according to embodiments of the present disclosure can improve the heat exchange efficiency of the heat exchanger, facilitate the assembling of the heat exchanger and ensure the assembling quality.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or additional aspects and advantages of the present disclosure will become apparent and readily appreciated from the following descriptions of embodiments made with reference to the drawings.

Figure 1:
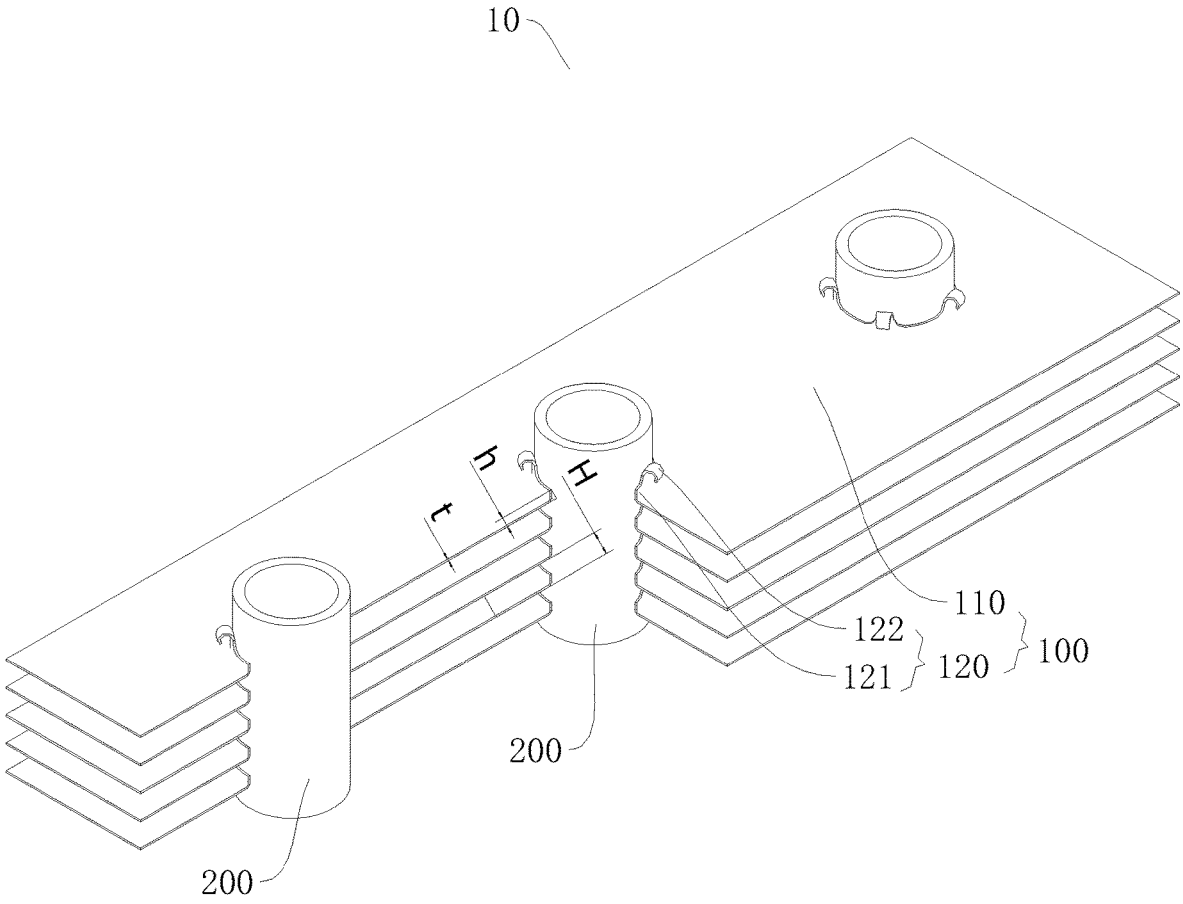
FIG. 1 is a schematic view of a heat exchanger according to an embodiment of the present disclosure.

REFERENCE NUMERALS heat exchanger 10 fin 100, fin body 110, heat exchange tube hole 111, flange 120, first sub-flange 121, second sub-flange 122, transition segment 124 heat exchange tube 200.

DETAILED DESCRIPTION

Embodiments of the present disclosure will be described in detail below, and examples of the embodiments will be illustrated in the accompanying drawings. The same or similar reference numerals represent the same or similar elements or the elements having the same or similar functions throughout the descriptions. The embodiments described below with reference to the accompanying drawings are exemplary, are merely used to explain the present disclosure, and cannot be construed to limit the present disclosure.

In the description of the present disclosure, it should be understood that terms such as "central," "longitudinal," "transverse," "length," "width," "thickness," "radial," "circumferential" and the like should be construed to refer to the orientation as then described or as illustrated in the drawings under discussion. These terms are for convenience and simplification of description and do not indicate or imply that the device or element referred to must have a particular orientation, or be constructed and operated in a particular orientation, so these terms shall not be construed to limit the present disclosure. In addition, the feature defined with "first" and "second" may comprise one or more of these features. In the description of the present disclosure, the term "a plurality of" means two or more than two, unless specified otherwise.

In the present disclosure, it should be noted, unless specified or limited otherwise, the terms "mounted," "connected," "coupled" or the like are used broadly. The terms may be, for example, fixed connections, detachable connections, or integral connections; may also be mechanical or electrical connections, may also be direct connections or indirect connections via intervening structures; and may also be inner communications of two elements, which can be understood by those skilled in the art according to specific situations.

A heat exchanger 10 according to embodiments of the present disclosure will be described below with reference to the drawings.

As illustrated in FIGS. 1-4, the heat exchanger 10 according to embodiments of the present disclosure includes a fin 100 and a heat exchange tube 200.

The fin 100 includes a fin body 110 and a flange 120, the fin body 110 is provided with a heat exchange tube hole 111, and the flange 120 is arranged on the fin body 110 and surrounds the heat exchange tube hole 111. The heat exchange tube 200 passes through the heat exchange tube hole 111 and is connected to the flange 120, such that a connection between the heat exchange tube 200 and the fin 100 is realized.

The flange 120 includes a first sub-flange 121 and a plurality of second sub-flanges 122. The first sub-flange 121 is connected to the fin body 110 and extends to form a structure in a shape of a closed loop along a circumferential direction of the heat exchange tube hole 111. That is, the first sub-flange 121 surrounds the full circumference of the heat exchange tube hole 111. The plurality of the second sub-flanges 122 are connected to the first sub-flange 121 and are spaced apart from one another along a circumferential direction of the first sub-flange 121. A height of the first sub-flange 121 is less than that of the second sub-flange 122.

It should be understood that a plurality of heat exchange tubes 200 and a plurality of fins 100 can be provided. The fin bodies 110 of the plurality of fins 100 are spaced apart from one another along a thickness direction of the fin body 110, the plurality of heat exchange tubes 200 are spaced apart from one another along a longitudinal direction of the fin 100, and the plurality of heat exchange tubes 200 are connected to each fin 100 through insertion.

Optionally, an outer peripheral surface of the heat exchange tube 200 is welded to an inner peripheral surface of the flange 120.

In the heat exchanger 10 according to the embodiments of the present disclosure, the connection between the heat change tube 200 and the fin 100 is achieved by means of the flange 120. The flange 120 is provided with a structure of the first sub-flange 121 and the plurality of second sub-flanges 122, i.e. the flange 120 includes both the first sub-flange 121 along the full circumference and the plurality of second sub-flanges spaced apart from one another.

On one hand, gaps defined by the second sub-flange 122 in a circumferential direction of the heat exchange tube 200 are conducive to smooth movement of a welding flux into a position between the heat exchange tube 200 and flange 120 and promote uniform flow of the welding flux at connection, which reduces heat transfer resistance and improves heat exchange efficiency. The welded connection is relatively good in corrosion resistance, thereby reducing a risk of heat exchanger failures caused by separation between a wall of the heat exchange tube 200 and the fin 100. The structure of the heat exchanger with welded connection between the heat exchange tube 200 and the fin 100 will be more compact, and the rigidity of the heat exchanger 10 will also be increased accordingly.

On the other hand, during mounting, the plurality of heat exchange tubes 200 can pass through the plurality of fins 100 simultaneously. The heights of the second sub-flange 122 and the first sub-flange 121 can ensure the spacing between fins 100 so as to position the adjacent fins 100. The gaps defined by the second sub-flange 122 in the circumferential direction of the heat exchange tube 200 ensure the mounting between the heat exchange tube 200 and the fins 100, improve the production efficiency while ensure dimensional consistency at each connection position, and reduce stress concentration, thus improving the quality of welding connection between the heat exchange tube 200 and the fins 100, facilitating assembling, and improving the assembly efficiency and prolonging the service life of the heat exchanger.

In addition, the heat exchange tube 200 of the heat exchanger 10 is not limited to have a circular tube structure and cannot be limited to unable expansion due to small heat exchange tube 200, thus greatly enlarging the application range of the heat exchanger 10.

Therefore, the heat exchanger 10 according to the embodiments of the present disclosure has the advantages of high heat exchange efficiency, easy assembly, and ensured assembly quality.

A heat exchanger 10 according to a specific embodiment of the present disclosure will be described below with reference to the drawings.

As illustrated in FIGS. 1-4, the heat exchanger 10 according to the embodiments of the present disclosure includes a fin 100 and a heat exchange tube 200.

Figure 3:
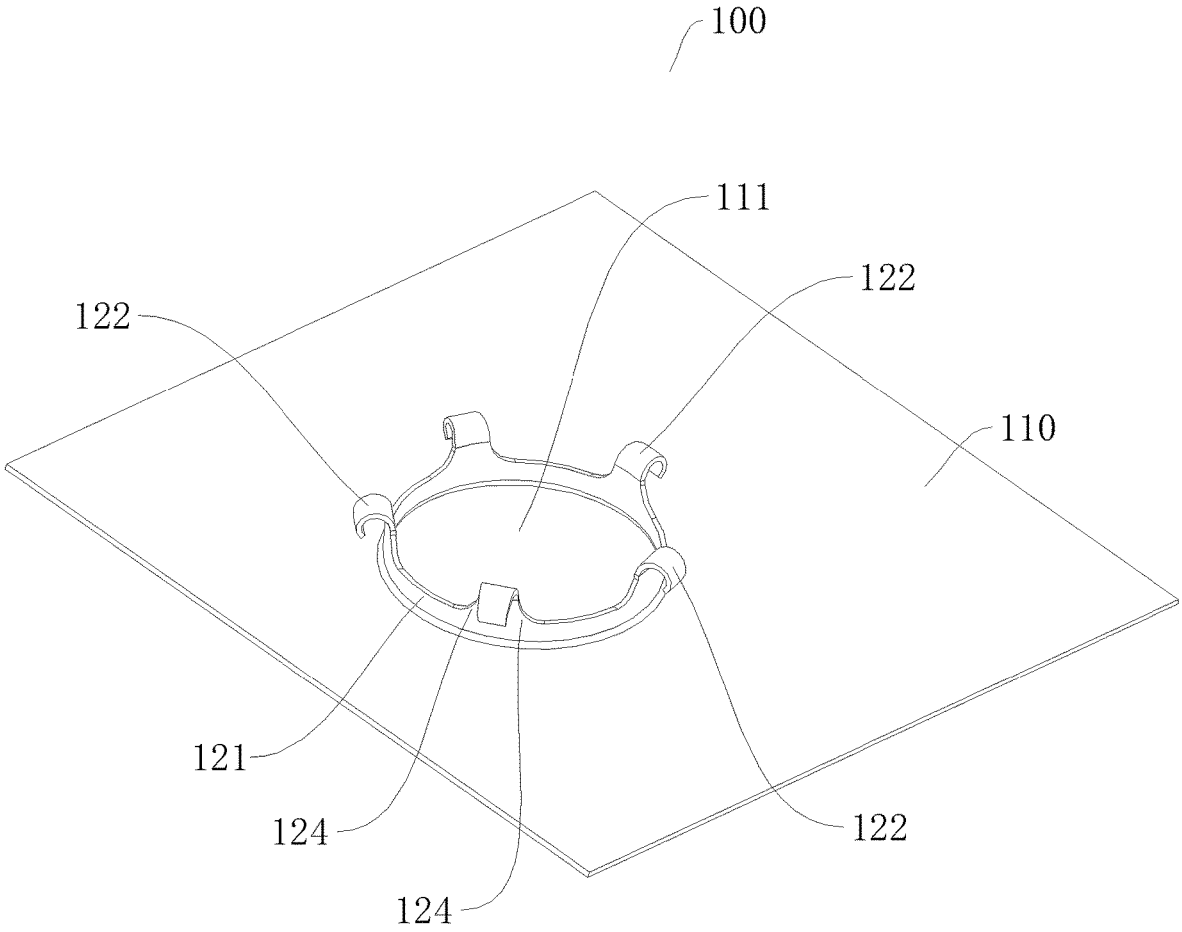
FIG. 3 is a schematic view of a fin of a heat exchanger according to another embodiment of the present disclosure.

As illustrated in FIG. 3, the second sub-flange 122 and the first sub-flange 121 are arranged in a spacing direction of adjacent fin bodies 110, and the second sub-flange 122 can be further bent outwards into an arc structure or a polyline structure along a radial direction of the flange 120. In other words, the outwardly bent part may be a partial arc structure of a circular structure or include a multiple-straight-line structure. Of course, the second sub-flange 122 may also be bent outwards such that the bent part is perpendicular to an unbent part. Thus, positioning the adjacent fin bodies 110 can be improved, the structure is more stable, and a risk scratch on the fin 100 caused by the flange 120 can be reduced.

Optionally, an end of the first sub-flange 121 adjacent to the second sub-flange is inwardly inclined along a radial direction of the heat exchange tube hole 111 with respect to an end of the first sub-flange 121 adjacent to fin body 110. That is, an internal diameter of the first sub-flange 121 is gradually reduced along a direction from the fin body 110 to the second sub-flange 122. Therefore, the heat exchange tube 200 can pass through the first sub-flange 121 from an end of a larger internal diameter, which is convenient for assembling and can ensure firm connection.

Figure 2:
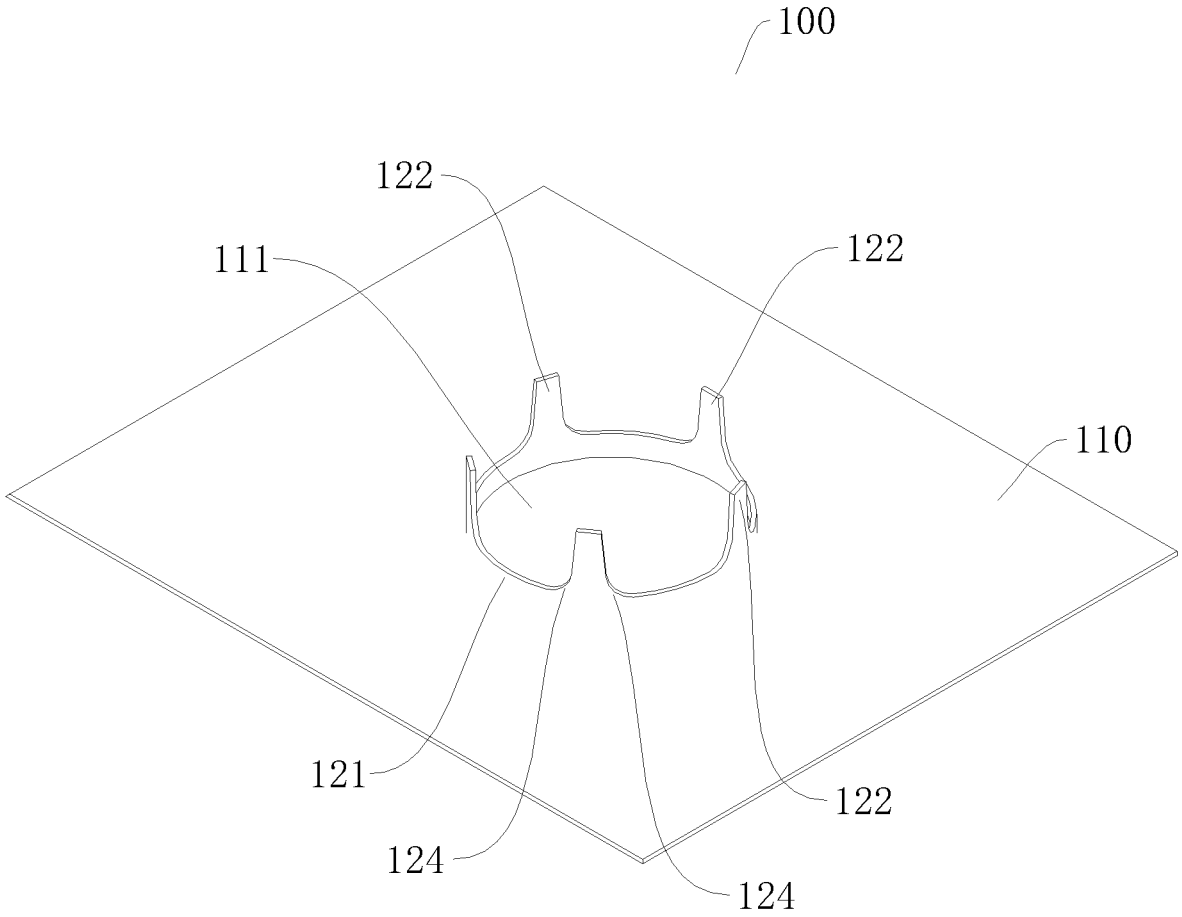
FIG. 2 is a schematic view of a fin of a heat exchanger according to an embodiment of the present disclosure.
Figure 4:
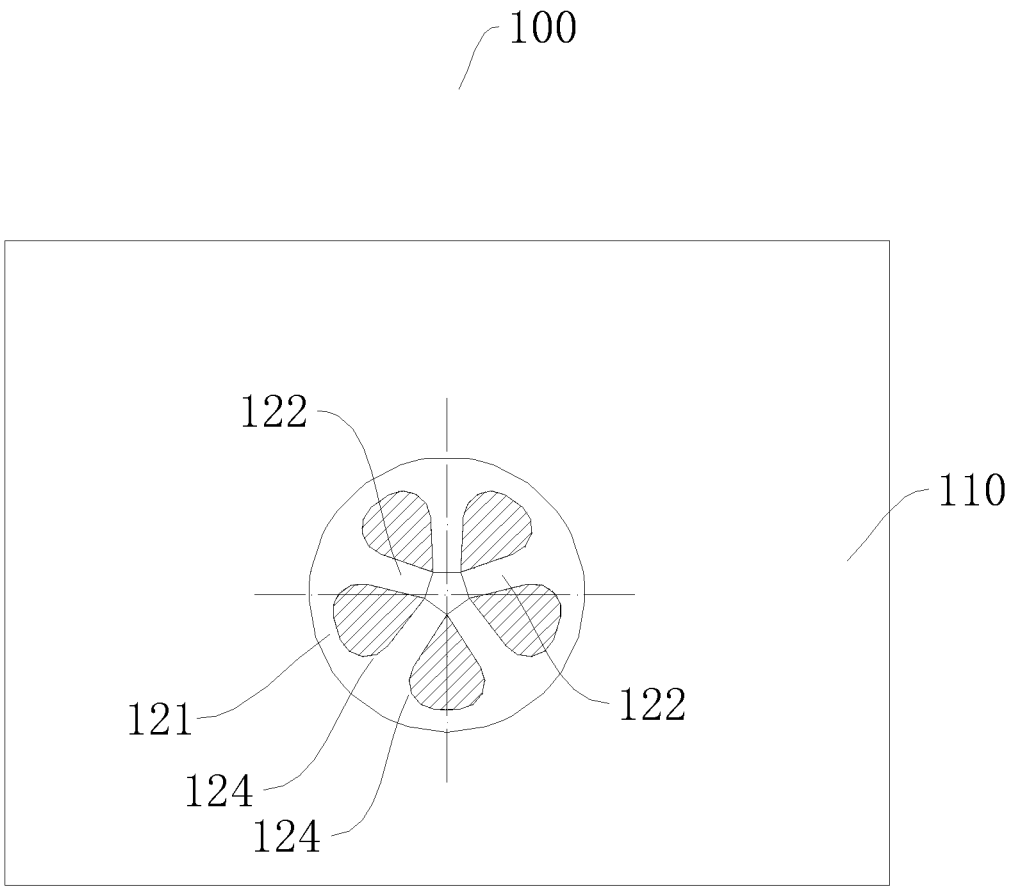
FIG. 4 is a schematic view of a heat exchanger with unflanged fin according to an embodiment of the present disclosure.

In some specific examples of the present disclosure, as illustrated in FIGS. 2-4, the first sub-flange 121 and the second sub-flange 122 are connected by a transition segment 124 of an arc structure or a polyline structure. That is, the transition segment 124 may be a part of an arc structure of a circular structure, or an arc segment structure of unequal radius, or includes a multiple-straight-line segment structure.

Optionally, as illustrated in FIG. 2, a width of the second sub-flange 122 is reduced gradually in a direction away from the first sub-flange 121. A plurality of second sub-flanges 122 may be symmetrically or asymmetrically distributed along a radial direction of flange 120.

In some specific embodiments of the present disclosure, as illustrated in FIG. 1, the height h of the first sub-flange 121 is greater than the thickness t of the fin body 110 and less than a spacing H between the adjacent fin bodies 110. In other words, the height of the first sub-flange 121 is represented by h, the thickness of the fin body 110 is represented by t, and the spacing between adjacent fin bodies 110 is represented by h, $t<h<H$. Therefore, not only the heat exchange tube 200 can be conveniently mounted to the heat exchange tube hole 111, the amount of welding flux and a partial stress concentration can be reduced, and the service life of the heat exchanger can be ensured, but also the welding area can be ensured, so as to influence effectiveness of the connection between the heat exchange tube 200 and the fin 100, thereby ensuring the connection between the fin 100 and the heat exchange tube 200 and the heat transfer area to improve heat exchange performance.

Furthermore, the height h of the first sub-flange 121 and the thickness t of the fin body 110 further meet the following requirement: $2t \le h \le 20t$.

Furthermore, the height h of the first sub-flange 121 and the thickness t of the fin body 110 further meet the following requirement: $4t \le h \le 10t$.

In some specific embodiments of the present disclosure, an unfolded area of the flange 120 is represented by S, a minimum inner circumference of the first sub-flange 121 is represented by C, and an unfolded height of the flange 120 is H1, $0.1 \le S/(CH1) \le 0.9$. The unfolded area of the flange 120 is represented by S which is referred as to a projection area of the flange 120 on a plane after the flange 120 is unfolded in the plane. The unfolded height of the flange 120 is referred as to a projection height of the flange 120 in the plane, and that is a vertical distance between an end of the first sub-flange 121 adjacent to the fin body 110 and an end of the second sub-flange 122 away from the fin body 110.

Thus, on one hand, the contact area between the heat exchange tube 200 and the fin 100 can be ensured to ensure heat exchange; one the other hand, the dimensional consistency at connection position of each heat exchange tube 200 can be ensured, thus preventing partial stress concentration at the connection position, so as to avoid the fins 100 from tearing and ensure the heat exchange effect and service life.

It should be understood that shapes of heat exchange tube hole 111 and heat exchange tube 200 includes but are not limited to circular shape, elliptical shape, flat tube shape or polygon. No matter which shapes the heat exchange tube hole 111 and heat exchange tube 200 have, as long as a parameter S/(CH') is controlled between 0.1 and 0.9, good assembling performance and welding quality can be acquired.

In some specific embodiments of the present disclosure, a ratio of a sum of widths of the plurality of second sub-flanges 122 at a middle position in a height direction to the minimum inner circumference of the first sub-flange 121 is represented by β, $0.08 \le \beta < 1$. The height of the second sub-flange 122 is referred as to a projection distance of the second sub-flange 122 in an axial direction with respect to the heat exchange tube 200 inserted in the corresponding heat exchange tube hole 111, thus not only ensuring smooth mounting and positioning, but also ensuring the welding area of the heat exchange tube 200 during welding, so as to avoid the welding flux from overflowing.

Furthermore, the ratio β of the sum of widths of the plurality of second sub-flanges 122 at the middle position in the height direction to the minimum inner circumference of the first sub-flange 121 further meets a requirement: $0.25 \le \beta < 0.5$.

In some specific examples of the present disclosure, the heat exchange tube 200 is a flat tube. The shape of the heat exchange tube hole 111 and the shape of the flange 120 match the shape of the heat exchange tube 200, and the ratio β of the sum of widths of the plurality of second sub-flanges 122 at the middle position in the height direction to the minimum inner circumference of the first sub-flange 121 further meets a requirement: $0.85 \leq \beta < 1$. Thus, the quality and strength of welding between the heat exchange tube 200 and the fin 100 can be fully and well acquired.

The fin 100 according to embodiments of the present disclosure will be described below with reference to the drawings.

As illustrated in FIGS. 2-4, the fin 100 according to embodiments of the present disclosure includes a fin body 110 and a flange 120.

The fin body 110 is provided with a heat exchange tube hole 111. The flange 120 includes a first sub-flange 121 and a plurality of second sub-flanges 122. The first sub-flange 121 is connected to the fin body 110 and extends to form a structure in a shape of a closed loop along a circumferential direction of the heat exchange tube hole 111. That is, the first sub-flange 121 surrounds the full circumference of the heat exchange tube hole 111. The plurality of the second sub-flanges 122 are connected to the first sub-flange 121 and are spaced apart from one another along a circumferential direction of the first sub-flange 121. A height of the first sub-flange 121 is less than that of the second sub-flange 122.

Optionally, an end of the first sub-flange 121 adjacent to the second sub-flange 122 is inwardly inclined along a radial direction of the heat exchange tube hole 111 with respect to an end of the first sub-flange 121 adjacent to fin body 110. That is, an internal diameter of the first sub-flange 121 is gradually reduced along a direction from the fin body 110 to the second sub-flange 122. Therefore, the heat exchange tube 200 can pass through the first sub-flange 121 from an end of a larger internal diameter, which is convenient for assembling and can ensure firm connection.

The fin 100 according to embodiments of the present disclosure can improve the heat exchange efficiency of the heat exchanger, facilitate assembling of the heat exchanger and ensure the assembling quality.

Reference throughout this specification to terms "an embodiment," "some embodiments," "an illustrative embodiment," "an example," "a specific example," or "some examples" means that a particular feature, structure, material, or characteristic described in connection with the embodiment or example is included in at least one embodiment or example of the present disclosure. In this specification, the appearances of the aforesaid terms are not necessarily referring to the same embodiment or example. Moreover, the particular features, structures, materials, or characteristics described can be combined in any suitable manner in one or more embodiments or examples.

Although embodiments of the present disclosure have been illustrated and described above, it should be understood by those skilled in the art that changes, modifications, alternatives, and variations can be made in the embodiments without departing from principles and purposes of the present disclosure. The scope of this disclosure is defined by the claims and their equivalents.

The invention claimed is:

1. A heat exchanger, comprising:

a fin comprising a fin body and a flange, the fin body being provided with a heat exchange tube hole, and the flange being arranged on the fin body and surrounding the heat exchange tube hole; and a heat exchange tube passing through the heat exchange tube hole and connected to the flange, wherein the flange comprises a first sub-flange and a plurality of second sub-flanges, the first sub-flange is connected to the fin body and extends to form a structure in a shape of a closed loop along a circumferential direction of the heat exchange tube hole, the plurality of the second sub-flanges are connected to the first sub-flange and spaced apart from one another along a circumferential direction of the first sub-flange, each second sub-flange comprises an arc portion or a multiple-straight-line portion, a height of the second sub-flange is referred as to a projection height of the second sub-flange in an axial direction with respect to the heat exchange tube, and a height of the first sub-flange is less than the height of the second sub-flange, wherein a plurality of fins are provided, fin bodies of adjacent fins are arranged along a thickness direction of the fin bodies, a minimum inner circumference of the first sub-flange is represented by C, and an unfolded area of the flange is represented by S, and an unfolded height of the flange is represented by H1, wherein $0.1 \leq S/CH1 \leq 0.9$.

2. The heat exchanger according to claim 1, wherein a height h of the first sub-flange is greater than a thickness t of the fin body and less than a spacing H between adjacent fin bodies.

3. The heat exchanger according to claim 1, wherein a height h of the first sub-flange is greater than or equal to twice a thickness t of the fin body or less than or equal to twenty times the thickness of the fin body.

4. The heat exchanger according to claim 1, wherein a height h of the first sub-flange is greater than or equal to four times a thickness t of the fin body or less than or equal to ten times the thickness of the fin body.

5. The heat exchanger according to claim 1, wherein a ratio of a sum of widths of the plurality of second sub-flanges at a middle position of each sub-flange in a height direction to a minimum inner circumference of the first sub-flange is represented by β, $0.08 \leq \beta < 1$.

6. The heat exchanger according to claim 5, wherein the ratio β of the sum of widths of the plurality of second sub-flanges at the middle position of each sub-flange in the height direction to the minimum inner circumference of the first sub-flange further meets a requirement: $0.25 \leq \beta < 0.5$.

7. The heat exchanger according to claim 5, wherein the heat exchange tube is configured as a flat tube, a shape of the heat exchange tube hole and a shape of the flange match a shape of the heat exchange tube, and the ratio β of the sum of widths of the plurality of second sub-flanges at the middle position in the height direction to the minimum inner circumference of the first sub-flange further meets a requirement: $0.85 \leq \beta < 1$.

8. The heat exchanger according to claim 1, wherein a width of the second sub-flange is gradually reduced in a direction away from the first sub-flange.

9. The heat exchanger according to claim 1, wherein the second sub-flange is bent outwards into an arc structure or a polyline structure along a radial direction of the flange.

10. The heat exchanger according to claim 1, wherein the heat exchange tube is welded to the flange.

11. A fin, comprising:

a fin body provided with a heat exchange tube hole;

a flange provided on the fin body and comprising a first sub-flange and a plurality of second sub-flanges, the first sub-flange being connected to the fin body and extending to form a structure in a shape of a closed loop along a circumferential direction of the heat exchange tube hole, the plurality of the second sub-flanges being connected to the first sub-flange and spaced apart from one another along a circumferential direction of the first sub-flange, and a height of the first sub-flange being less than a height of the second sub-flange, wherein an end of the first sub-flange adjacent to the second sub-flange is inwardly inclined along a radial direction of the heat exchange tube hole with respect to an end of the first sub-flange adjacent to the fin body wherein a ratio of a sum of widths of the plurality of second sub-flanges at a middle position of each sub-flange in a height direction to a minimum inner circumference of the first sub-flange is represented by β, wherein $0.08 \leq \beta < 1$.

12. The fin according to claim 11, wherein a height h of the first sub-flange is greater than or equal to twice a thickness t of the fin body or less than or equal to twenty times the thickness of the fin body.

13. The fin according to claim 11, wherein the second sub-flange is bent outwards into an arc structure or a polyline structure along a radial direction of the flange.

14. The heat exchanger according to claim 1, wherein the arc portion or the multiple-straight-line portion further comprises at least one portion in parallel with the first sub-flange in the axial direction with respect to the heat exchange tube.

15. The heat exchanger according to claim 2, wherein the height h of the first sub-flange is greater than or equal to twice the thickness t of the fin body or less than or equal to twenty times the thickness of the fin body.

16. The heat exchanger according to claim 2, wherein the height h of the first sub-flange is greater than or equal to four times the thickness t of the fin body or less than or equal to ten times the thickness of the fin body.

17. A heat exchanger, comprising:

a fin comprising a fin body and a flange, the fin body being provided with a heat exchange tube hole, and the flange being arranged on the fin body and surrounding the heat exchange tube hole; and a heat exchange tube passing through the heat exchange tube hole and connected to the flange, wherein the flange comprises a first sub-flange and a plurality of second sub-flanges, the first sub-flange is connected to the fin body and extends to form a structure in a shape of a closed loop along a circumferential direction of the heat exchange tube hole, the plurality of the second sub-flanges are connected to the first sub-flange and spaced apart from one another along a circumferential direction of the first sub-flange, each second sub-flange comprises an arc portion or a multiple-straight-line portion, a height of the second sub-flange is referred as to a projection height of the second sub-flange in an axial direction with respect to the heat exchange tube, and a height of the first sub-flange is less than the height of the second sub-flange;

wherein a ratio of a sum of widths of the plurality of second sub-flanges at a middle position of each sub-flange in a height direction to a minimum inner circumference of the first sub-flange is represented by β, wherein $0.08 \leq \beta < 1$.

18. The heat exchanger according to claim 17, wherein a plurality of fins are provided, fin bodies of adjacent fins are arranged along a thickness direction of the fin bodies, and a height h of the first sub-flange is greater than a thickness t of the fin body and less than a spacing H between adjacent fin bodies.

19. The heat exchanger according to claim 17, wherein a height h of the first sub-flange is greater than or equal to twice a thickness t of the fin body or less than or equal to twenty times the thickness of the fin body.

* * * * *